US011172767B1

(12) United States Patent
Kong et al.

(10) Patent No.: US 11,172,767 B1
(45) **Date of Patent: *Nov. 16, 2021**

(54) PORTABLE PERSONAL BAG WITH BUILT-IN PRIVACY CHANGING STATION

(71) Applicant: Paperclip Parent, LLC, Chatsworth, CA (US)

(72) Inventors: C. Kwai Kong, Gilroy, CA (US); Alan John Buckley, Marina Del Rey, CA (US); Arthur Kenneth Baxter, III, Los Angeles, CA (US); Johnny Chi-Pao Liao, Irvine, CA (US); Yu He, Ningbo (CN)

(73) Assignee: PAPERCLIP PARENT, LLC, Gilroy, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/828,937

(22) Filed: Mar. 24, 2020

Related U.S. Application Data

(63) Continuation-in-part of application No. 15/212,897, filed on Jul. 18, 2016, now Pat. No. 10,595,646.

(60) Provisional application No. 62/193,223, filed on Jul. 16, 2015.

(51) Int. Cl.

| | |
|---|---|
| ***A47D 5/00*** | (2006.01) |
| ***A47D 15/00*** | (2006.01) |
| ***A45F 4/02*** | (2006.01) |
| ***A45C 9/00*** | (2006.01) |
| ***A45C 15/00*** | (2006.01) |
| ***A45C 3/06*** | (2006.01) |

(52) U.S. Cl.
CPC ..... *A47D 5/006* (2013.01); *A45C 3/06* (2013.01); *A45C 9/00* (2013.01); *A45C 15/00* (2013.01); *A45F 4/02* (2013.01); *A47D 15/00* (2013.01)

(58) Field of Classification Search
CPC ..... A45F 4/02; A45F 2004/023; A45F 2004/026; A45F 4/04; A45F 4/06; A45F 4/08
See application file for complete search history.

(56) References Cited

U.S. PATENT DOCUMENTS 5,649,658 A * 7/1997 Hoffman ..... A45F 3/04 190/2
5,865,355 A * 2/1999 Camara ..... A45F 4/02 135/143
6,390,260 B1 5/2002 Roegner
(Continued)

FOREIGN PATENT DOCUMENTS

DE 202013005636 10/2013
GB 2472841 2/2011

*Primary Examiner* — Eric J Kurilla
(74) *Attorney, Agent, or Firm* — Booth Udall Fuller, PLC

(57) ABSTRACT

A personal bag includes a diaper changing base, a back wall, and at least two privacy walls. The diaper changing base includes a front edge, a rear edge, lateral edges and a padded surface. The back wall includes a bottom edge and lateral edges. The privacy walls are coupled to the diaper changing base and the back wall, and extend along a majority of the length of a lateral edge of the diaper changing base and a lateral edge of the back wall. The rear edge of the diaper changing base is hingedly coupled to the bottom edge of the back wall and hingedly movable relative to the back wall between a closed position and a deployed position.

20 Claims, 12 Drawing Sheets

(56) References Cited

U.S. PATENT DOCUMENTS

| | | | | |
|---|---|---|---|---|
| 8,490,230 | B2 * | 7/2013 | Rovin | A47D 5/006 5/655 |
| 8,973,757 | B2 * | 3/2015 | Fimbrez | A45C 9/00 206/581 |
| 9,826,809 | B2 * | 11/2017 | Carter | A45C 9/00 |
| 9,918,563 | B1 * | 3/2018 | Lockett | A47D 5/006 |
| 10,160,363 | B2 * | 12/2018 | Aguilar Ruelas | B60N 2/90 |
| 10,595,646 | B2 * | 3/2020 | Kong | A47D 5/006 |
| 2002/0139820 | A1 * | 10/2002 | Godshaw | A45F 4/02 224/153 |
| 2005/0056668 | A1 * | 3/2005 | Aris | A45C 9/00 224/153 |
| 2009/0114690 | A1 * | 5/2009 | Landay | A45C 13/30 224/575 |
| 2010/0127024 | A1 * | 5/2010 | Cortes | A45F 4/02 224/153 |
| 2011/0314608 | A1 | 12/2011 | Rovin | |
| 2013/0228600 | A1 * | 9/2013 | Teixeira | A45F 4/08 224/156 |
| 2014/0374450 | A1 * | 12/2014 | Kruse | A45F 4/02 224/153 |
| 2015/0083764 | A1 * | 3/2015 | Houston | A45F 4/02 224/156 |
| 2015/0257500 | A1 | 9/2015 | Carter | |
| 2018/0078049 | A1 * | 3/2018 | Rhen | A45C 3/00 |
| 2019/0082817 | A1 * | 3/2019 | Ji | A47D 5/006 |

* cited by examiner

PORTABLE PERSONAL BAG WITH BUILT-IN PRIVACY CHANGING STATION

CROSS REFERENCE TO RELATED APPLICATIONS

This document is a continuation-in-part of U.S. patent application Ser. No. 15/212,897, issued as U.S. Pat. No. 10,595,646 on Mar. 24, 2020, titled "Privacy Diaper Changing Station with Privacy Walls", to Kong et al., which application claims priority to U.S. Provisional Application No. 62/193,223, titled "Privacy Diaper Changing Pad and Diaper Bag", filed Jul. 16, 2015, the disclosures of each of which are hereby incorporated by this reference.

BACKGROUND

1. Technical Field

Aspects of this document relate generally to portable personal bags with built-in privacy for diaper changing stations.

2. Background Art

Babies can be relied upon to do their business without any consideration for proximity to a convenient, clean, and private space for diaper changes. Changing a baby's diaper is a supply-intensive endeavor, and is ideally performed in a clean, controllable space. Conventional portable diaper changing stations do not offer much privacy for the baby, and are often cumbersome and unwieldy. Conventional portable diaper changing stations also do little to prevent the baby from reaching out and touching unclean surroundings while being changed.

Additionally, the numerous diaper changing supplies needed are traditionally carried in a separate container, or are stored in inconvenient places within a conventional changing station, such as in pockets hanging over the edge of a table. A diaper changer often begins and ends the diaper changing procedure while holding the baby in one arm. Conventional portable diaper changing stations are often difficult to setup and store with one hand. The lack of privacy, security, and convenience inherent in conventional portable diaper changing stations make an undesirable experience all the more difficult.

SUMMARY

According to one aspect, a portable diaper changing station includes a base, a back wall, and at least two privacy walls. The base has a front edge, a rear edge and lateral edges and a padded surface. The back wall has a bottom edge and lateral edges. Each privacy wall is coupled to and extends along a majority of a different lateral edge of the base, and is also coupled to and extends along a majority of a different lateral edge of the back wall.

The rear edge of the base is hingedly coupled to the bottom edge of the back wall and hingedly movable relative to the back wall between a closed position and a deployed position. In the closed position, the base is substantially parallel to the back wall and the at least two privacy walls are between the back wall and the base. In the deployed position, the base is substantially perpendicular to the back wall, an angle between the back wall and the base in the deployed position being defined by a size of the at least two privacy walls when in the deployed position.

The portable diaper changing station may include at least a first rigid frame segment coupled to the base and at least a second rigid frame segment coupled to the back wall. The first and second rigid frame segments may be coupled together through a biased hinge which may bias the base to the deployed position. The portable diaper changing station may also include first and second support sections which may be flexibly coupled to each other by a flexible connector. The portable diaper changing station may further include at least one brace which may be coupled to the first support section and which may be movable to a first position and/or a second position. In the first position, the brace may bridge the first and second support sections, while in the second position it may not. The brace may maintain the changing station in the deployed position when the at least one brace is in the first position.

The portable diaper changing station of claim may include an anchor strap affixed to the back wall and/or a movable strap having one end affixed to one of the at least two privacy walls. One of the anchor strap and the movable strap may include a hook portion of a hook and loop fastener material and the other of the anchor strap and the movable strap may include a loop portion of the hook and loop fastener material. The anchor strap may be aligned with the movable strap when the station is in the deployed position to form a hook and loop fastener connection.

Each of the two privacy walls may be releasably coupled to the back wall through a different fastener. Also, when in the deployed position there may be no barrier on the front edge of the base. The base may further include at least one fold line, and the back may also include at least one fold line which may be aligned with the at least one fold line of the base while in the closed position.

Folding the changing station in the closed position along the at least one fold lines on the back wall and base may convert the station from the closed position to a compact position. The back wall may further include at least one pocket on a surface of the back wall between the privacy walls. Finally, the back wall may include a sidewall of a bag.

According to another aspect, a portable diaper changing station includes a base, a bag, and at least two privacy walls. The base has a front edge, a rear edge and lateral edges and a padded surface. The bag includes at least one opening and a back wall, and the back wall has a bottom edge and lateral edges. Each privacy wall is coupled to and extends along a majority of a different lateral edge of the base, and is coupled to the bag, and also extends along a majority of a lateral edge of the back wall. The rear edge of the base is hingedly coupled to the bottom edge of the back wall and is hingedly movable relative to the back wall between a closed position and a deployed position. In the closed position, the base is substantially parallel to the back wall and the at least two privacy walls are between the back wall and the base. In the deployed position, the base is substantially perpendicular to the back wall, an angle between the back wall and the base in the deployed position being defined by a size of the at least two privacy walls when in the deployed position.

Each of the two privacy walls may be releasably coupled to the bag through a different fastener. The portable diaper changing station may further include an organizer comprising at least one pocket and may be coupled to the back wall between the privacy walls.

The base may serve as a lid for at least one of the at least one opening of the bag while the station is in the closed position. Lastly, the bag may also include a compartment located outside the base and the back wall and which may be accessible through one of the at least one openings of the bag when the station is in the open position and/or in the closed position.

According to still another aspect, a portable diaper changing station includes a base, a bag, and at least two privacy walls. The base has a front edge, a rear edge and lateral edges and a padded surface. The bag includes at least one opening and a back wall, and the back wall has a bottom edge and lateral edges.

Each privacy wall is coupled to and extends along a majority of a different lateral edge of the base, and is coupled to the bag, and also extends along a majority of a lateral edge of the back wall. The rear edge of the base is hingedly coupled to the bottom edge of the back wall and is hingedly movable relative to the back wall between a closed position and a deployed position. In the closed position, the base is substantially parallel to the back wall and the at least two privacy walls are between the back wall and the base. In the deployed position, the base is substantially perpendicular to the back wall, an angle between the back wall and the base in the deployed position being defined by a size of the at least two privacy walls when in the deployed position. The base, the back wall, and the at least two privacy walls are enclosed within an outer pocket of the bag when in the closed position. Finally, the portable diaper changing station may also include a rechargeable power source.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

The invention will hereinafter be described in conjunction with the appended drawings, where like designations denote like elements, and.

DESCRIPTION

Figure 1A:
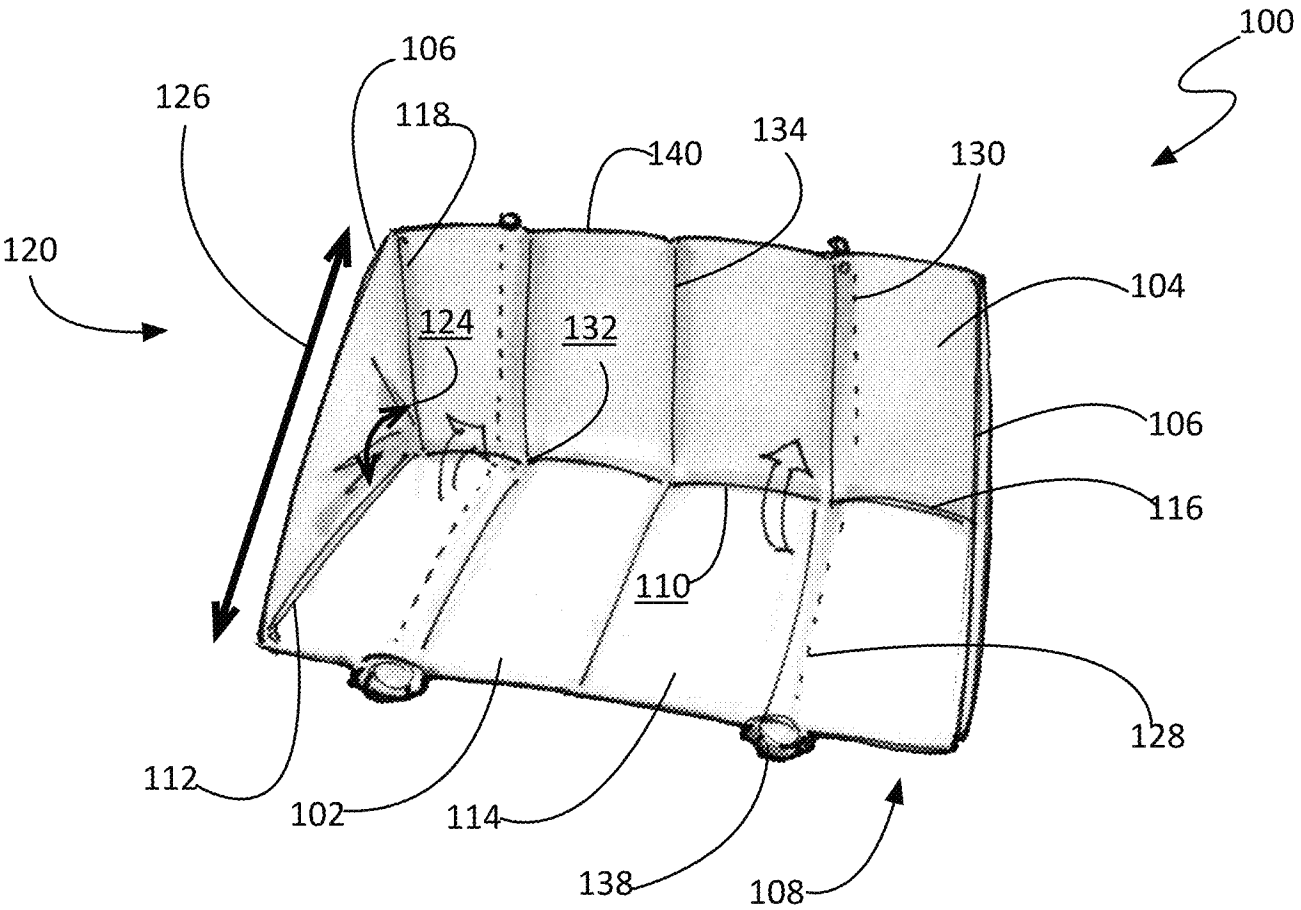
FIGS. 1A-1D are perspective views of a particular implementation of a portable diaper changing station with privacy walls and a biased hinge in deployed, closed, and compact positions.

This disclosure, its aspects and implementations, are not limited to the specific components or assembly procedures disclosed herein. Many additional components and assembly procedures known in the art consistent with the intended portable diaper changing stations and/or assembly procedures for portable diaper changing stations will become apparent for use with implementations of portable diaper changing stations from this disclosure. Accordingly, for example, although particular changing stations are disclosed, such changing stations and implementing components may comprise any shape, size, style, type, model, version, measurement, concentration, material, quantity, and/or the like as is known in the art for such portable diaper changing stations and implementing components, consistent with the intended operation of diaper changing stations.

FIGS. 1 through 9 depict non-limiting embodiments of a portable diaper changing station configured as a personal bag having the portable diaper changing station built-in. The personal bag includes a base 102, a back wall 104, and two privacy walls 106. The privacy walls 106 are each coupled to separate lateral edges 112 of the base, and extend along a majority 412 of the length of the edge 112 to which they are coupled. The privacy walls 106 are also coupled to the back wall 104 or, in some embodiments, coupled to a bag 402 to which the back wall 104 is also coupled (see, for example, personal bags 400, 600, 700, 800, and 900). Furthermore, the privacy walls 106 extend along a majority 414 of the length of a lateral edge 118 of the back wall 104, and fill an opening between the back wall 104 and the base 102 to provide a level of privacy for the baby.

The base 102 includes a front edge 108, a rear edge 110, lateral edges 112, and a padded surface 114. In some embodiments, the base 102 may have two lateral edges 112. In other embodiments, the base 102 may have more than two lateral edges 112 See, for example, the personal bag 600 in FIG. 6, whose base 102 has four lateral edges 112. Furthermore, the back wall 104 includes a bottom edge 116, a top edge 140, and lateral edges 118.

The rear edge 110 of the base 102 is hingedly coupled to the bottom edge 116 of the back wall 104, allowing the base 102 to move in a hinged fashion with respect to the back wall 104. In various embodiments, the extent to which base 102 may swing open with respect to the back wall 104 (e.g. angle 124, etc.) is constrained by a size 126 of the privacy walls 106. In other words, while coupled to the base 102 and the back wall 104 (or a bag 402, in some embodiments), the geometry of the privacy walls 106 may restrict the base 102 from opening with respect to the back wall 104 beyond a certain angular point.

The state in which the angle 124 between the base 102 and the back wall 104 is defined by the size 126 of the privacy walls 106, and in which the base 102 is substantially perpendicular to the back wall 104, is the deployed position 120. In the context of the present description and the claims which follow, 'substantially perpendicular' refers to an angle 124 between the base 102 and the back wall 104 ranging from 75 degrees to 105 degrees, or within 15 degrees of perpendicular. A personal bag with a portable diaper changing station in the deployed position 120 is illustrated in FIGS. 1A, 2A, 2D, 2E, 3A, 4A, 5, 6, 7A, 8A, and 9A. As shown, when in the deployed position 120, the portable diaper changing station is ready for use, the privacy walls 106 being raised and expanded to shield the flattened base 102.

FIGS. 1B, 2C, 4C, 7B, 8B, and 9B illustrate non-limiting embodiments of a portable diaper changing station in the closed position 122, where the base 102 is substantially parallel to the back wall 104 and the privacy walls 106 are contained between the back wall 104 and the base 102. In the context of the present description and the claims which follow, 'substantially parallel' refers to an angle 124 between the base 102 and the back wall 104 ranging from 0 degrees to 15 degrees. In some embodiments, such as those shown in FIGS. 1C and 2C, the base 102 and the back wall 104 in the closed position 122 may be non-planar, so long as they remain substantially parallel to each other. In various embodiments, including those illustrated in FIGS. 1B, 2C, 4C, 7B, 8B, and 9B, the privacy walls 106 may fold, bend, collapse, or crumple inward to be contained between the base 102 and the back wall 104 as the station is converted from a deployed position 120 to a closed position 122.

Diaper changes are often required in less than ideal circumstances, away from a well-stocked, clean, and private space. The privacy walls 106, along with the back wall 104, may serve to create a space where a diaper change can be performed in private. These walls may shield the baby from the view of others, without obstructing the view or physical access of the diaper changer, hereinafter referred to as the user.

Diaper changes on the go are sometimes performed in an unclean environment. The portable diaper changing station may serve to confine the baby to a clean, controlled area while the diaper is being changed. The privacy walls 106 and back wall 104 may further prevent a baby from reaching out and touching something near the diaper changing station, which may be unclean. These walls may also prevent the baby from rolling over and out of the sides or back of the changing area away from the user, possibly resulting in injury to the baby.

Changing a diaper can also be a supply-intensive activity, possibly involving a fresh diaper, wipes, powder, ointment, or other related supplies. As seen in the non-limiting embodiments of a personal bag illustrated in FIGS. 2-4 and 6-9, a surface 216 of the back wall 104 may comprise one or more pockets 214 (e.g. personal bags 200, 300, and 600, etc.) or may be coupled to an organizer 410 (e.g. personal bags 400, 700, 800, and 900, etc.). Advantageously, placing storage (e.g. pocket 214, organizer 410, etc.) on or near the back wall 104 makes it visible and easy accessible to the user while the station is in a deployed position 120. Prior diaper changing stations that lie completely flat need separate storage, take up additional area, or place storage in inconvenient places.

Some embodiments of the personal bag with a portable diaper changing station incorporate a bag 402, such as the non-limiting embodiments shown in FIGS. 4-9. Other embodiments, such as the non-limiting embodiments shown in FIGS. 1-3, do not incorporate a bag 402. Both variations provide unique advantages. A user may desire the benefits of a changing station with privacy walls, yet also be able to use it with a variety of bags, such as a traditional diaper bag or a small handbag. On the other hand, embodiments of the station that comprise a bag 402 may have enhanced stability, in addition to expanded storage and the utility of the bag itself. The weight and structure of the bag may be leveraged to hold the back wall 104 upright and prevent the station from shifting during use. As an option, these embodiments may have non-slip feet or surface on the bottom of the bag 402. In still other embodiments, the advantages of both may be had, wherein the back wall 104 is releasably coupled to a sidewall 404 of the bag 402 such that it may be removed and used with another bag or by itself.

Often, the early and final steps of changing a diaper away from home must be accomplished while holding a baby, and are performed with the user's single free hand. Various embodiments of the personal bag assist the user with these initial and final one-handed operations. See, for example, personal bag 100 of FIGS. 1A-1D.

FIGS. 1A-1D are perspective views of a personal bag with a portable diaper changing station 100 with privacy walls 106 and a biased hinge 132. A first rigid frame segment 128 is coupled to the base 102, and a second rigid frame segment 130 is coupled to the back wall 104; both frame segments are coupled to the biased hinge 132. The biased hinge 132 is biased to open, making changing station 100 biased to the deployed position 120. First rigid frame segment 128 and second rigid frame segment 130 may be metal, thermoplastic, or any material strong enough to withstand the forces applied by the biased hinge 132. The biased hinge 132 may comprise any biased hinge known in the art including, but not limited to, spring bar hinges, spring steel hinges, and other biased components.

The rigid frame segments 128, 130 may be hidden inside the base 102 and/or the back wall 104, as shown in FIGS. 1A-1D. In other embodiments, one or more rigid frame segments may be visible on a surface of the base 102 and/or the back wall 104. As a specific example, the frame segments 128, 130 may be inserted into a series of loops on the outer surfaces of the base 102 and the back wall 104, making the frame/hinge assembly removable so the base 102 and back wall 104 (or at least an outer covering) may be washed. Alternatively, the rigid frame segments may be formed of a washable material, such as plastic.

As shown in FIG. 1A, personal bag with a portable diaper changing station 100 includes two sets of frame segments 128, 130 and two biased hinges 132. In some embodiments, a single set of frame segments 128, 130 and a biased hinge 132 may be used. In others, three or more sets of frame segments 128, 130 may be employed. The rigid frame segments, in addition to translating the tension of the biased hinge 132 to the base 102 and back wall 104 (and by extension, the privacy walls 106), may also serve to provide support for the back wall 104.

A personal bag with a portable diaper changing station 100 may also comprise clasp 138, by which the base 102 and the back wall 104 of station 100 may be releasable coupled in the closed position 122. In the context of the present description, a clasp 138 refers to any device with interlocking parts used for fastening things together. As an option, a clasp 138 may be actuated using a single hand (e.g. the press of a button, the pinching of tabs, pressing two halves of the clasp 138 together, etc.).

FIG. 1A depicts portable diaper changing station 100 in a deployed position 120. As shown, the tension provided by the biased hinge 132 and translated by the rigid frame segments 128, 130 causes the back wall 104 and the base 102 to hinge apart until the privacy walls 106 are taut, keeping the base 102 and the back wall 104 substantially perpendicular (specifically, at angle 124). Portable diaper changing station 100, a non-limiting embodiment of which is depicted in FIG. 1A, comprises privacy walls 106 lacking the structure exhibited in the privacy walls 106 of other disclosed embodiments, such as those illustrated in FIGS. 2 and 3. In various embodiments, the privacy walls 106 used in conjunction with a rigid frame and a biased hinge 132 may themselves comprise any degree of structure, panels, segments, or rigidity, including but not limited to the privacy walls depicted in the Figures of this disclosure.

Figure 1B:
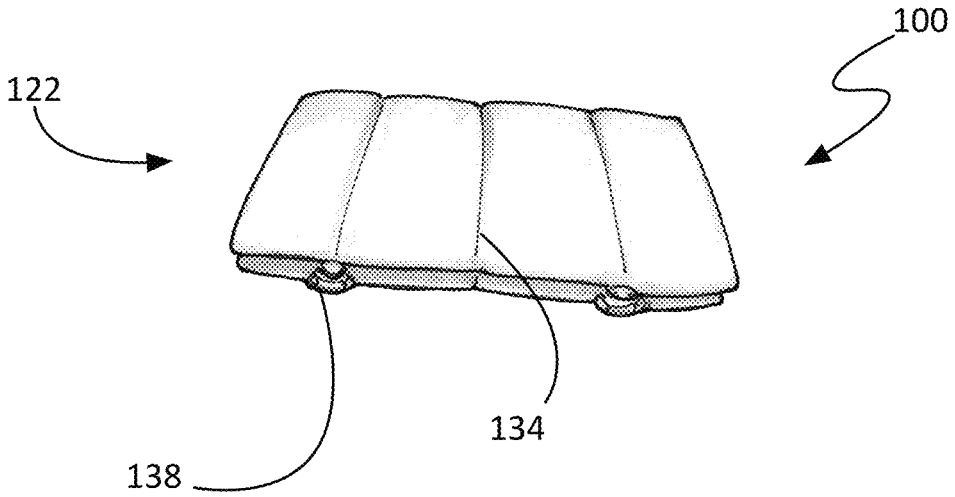
Figure 1C:
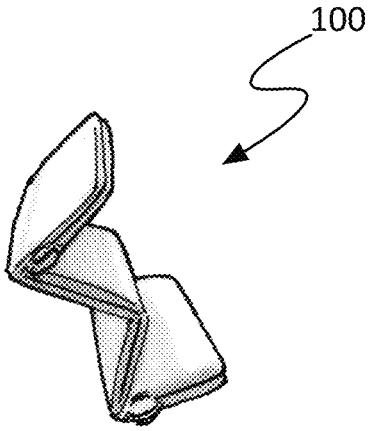
Figure 1D:
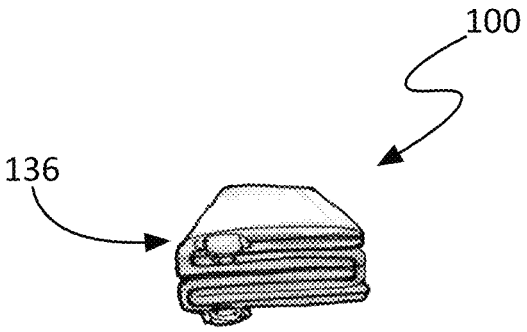

The user may apply force to the back wall 104, counter to the biased hinge 132, to convert the portable diaper changing station 100 from the deployed position 120 shown in FIG. 1A to the closed position 122 shown in FIG. 1B. In various embodiments, the outer surface of the base 102 may comprise a non-slip material such as rubber, preventing the base 102 from slipping during use as well as during a one-handed closing operation. As shown in FIG. 1B, the closed position 122 may be maintained by the clasp 138.

A user may wish to carry a personal bag, such as station 100 of FIGS. 1A-1D, in a container not compatible with a thin, flat, long object, such as a small handbag 402. Furthermore, a diaper changing station may incorporate a bag 402 smaller than the base 102 and back wall 104 when in a closed position 122. As seen in FIGS. 1A-1D, the portable diaper changing station 100 further comprises a number of fold lines 134. See also portable diaper changing station 200 of FIGS. 2A-2C. In the context of the present description and the claims which follow, a fold line may be a flexible band along which a fold or bend is facilitated. As a specific example, a fold line in the base 102 may not include padding. As shown, the fold lines of the base 102 and back wall 104 of station 100 are aligned when the station 100 is in a closed position 122 (FIG. 1B), allowing the station 100 to be folded while in the closed position 122 (see FIG. 1C) into the compact position 136 shown in FIG. 1D.

Various embodiments of the personal bag with a portable diaper changing station may include fold lines 134 or other structure to make the compact position 136 possible, beyond those depicted in FIGS. 1 and 2. In the context of the present description, a compact position 136 may refer to any arrangement of the base 102 and the back wall 104 in which the dimensions are made more cubic than planar. In other words, the longer and thinner profile of the closed position 122 may be made shorter and thicker by converting to a compact position 136, according to various embodiments. As an option, the compact position 136 may be maintained using a clasp 138, a strap, hook and loop material, a cover, a magnet, and/or any other method of confinement or attachment.

Figure 2A:
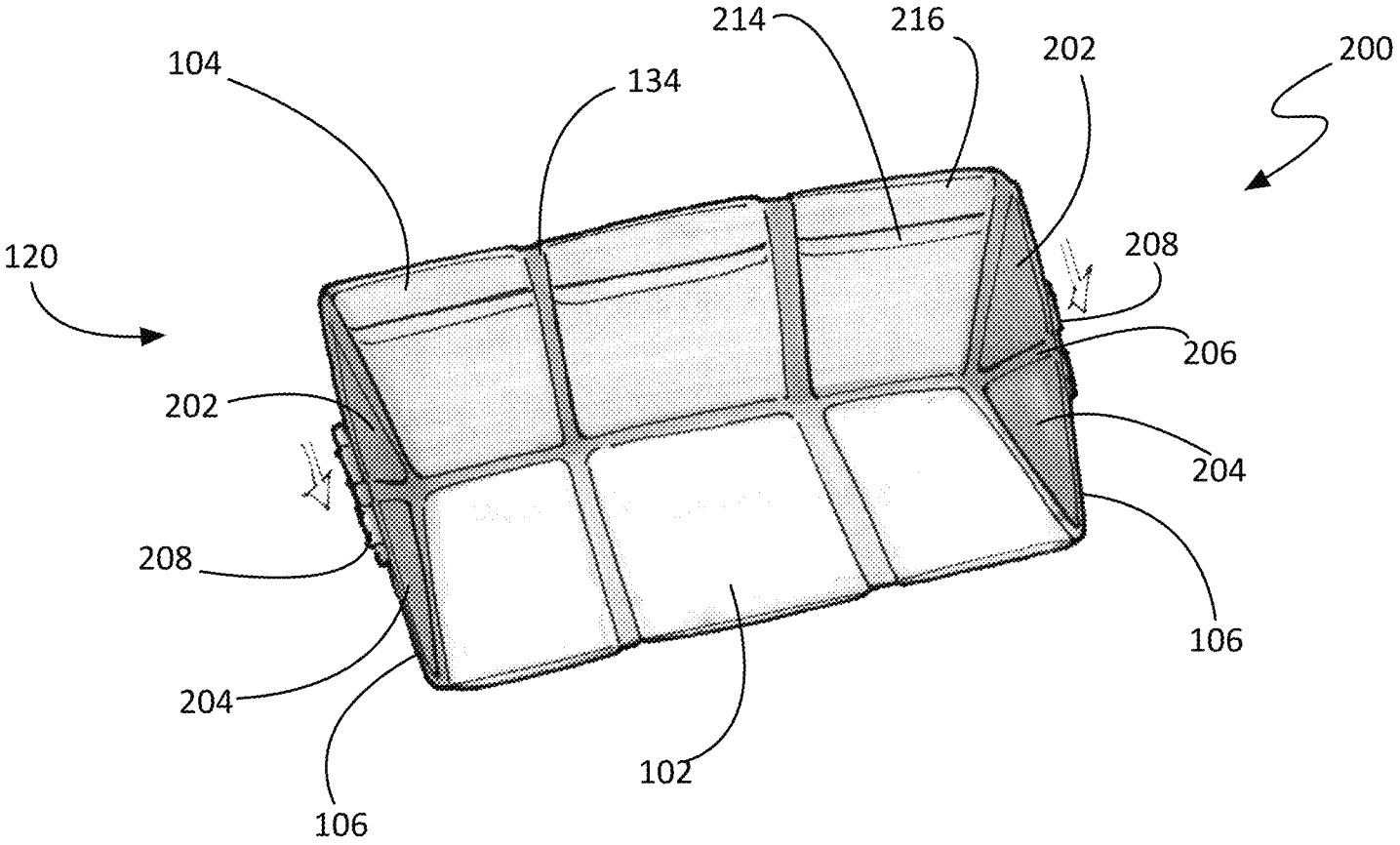
FIGS. 2A-2C are perspective views of a particular implementation of a portable diaper changing station with privacy walls and a brace in deployed and closed positions.
Figure 2B:
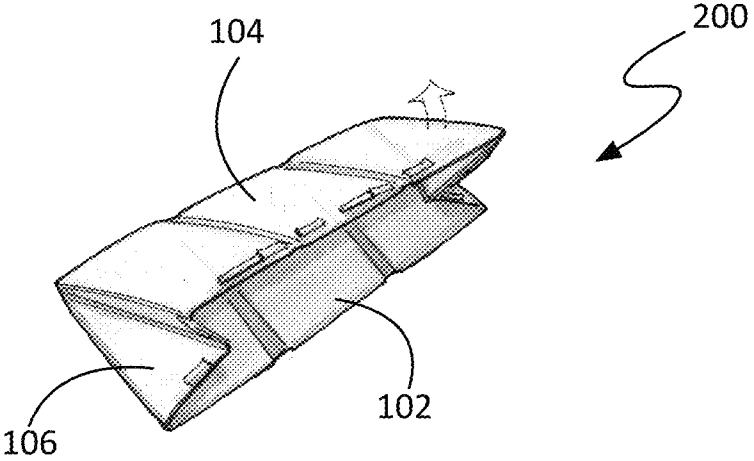
Figure 2C:
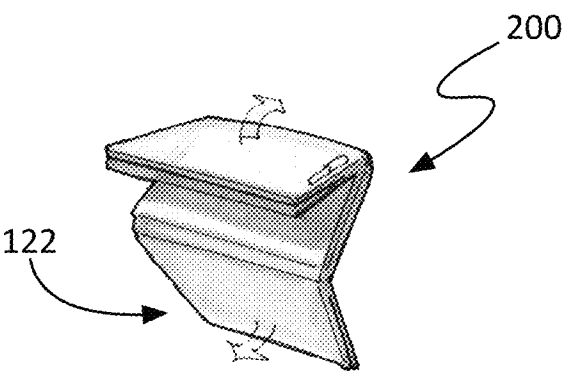

FIGS. 2A-2C are perspective views of another embodiment of a personal bag with a portable diaper changing station 200 with privacy walls 106 and a brace 208. FIG. 2A shows the portable diaper changing station 200 in the deployed position 120. Unlike changing station 100 of FIGS. 1A-1D, where the deployed position 120 is maintained by the structure of the base 102 and back wall 104 (specifically, the tension provided by the biased hinge 132), portable diaper changing station 200 is maintained in the deployed position 120 by the structure of the privacy walls 106. Specifically, the privacy walls 106 of portable diaper changing station 200 each comprise first and second support sections (e.g. 202 and 204, respectively), which are flexibly coupled to each other by a flexible connector 206. The support sections may be firm and less prone to bend than the flexible connector 206.

A shown, each privacy wall 106 also comprises a movable brace 208, which may be made of plastic, metal, or other materials which may resist bending when exposed to forces associated with the normal use of the diaper changing station. Preferably, the brace 208 may be movable with a single hand. When the brace 208 is in a first position 210, where the brace 208 bridges the first 202 and second 204 support sections, the privacy wall 106 is unable to bend along the flexible connector 206. Since the privacy walls 106 are coupled to the base 102 and back wall 104, the privacy walls' 106 inability to bend when the braces 208 are in the first position 210 helps maintain the base 102 and the back wall 104 in a deployed position 120 (substantially perpendicular to each other).

When the brace 208 is moved from the first position 210 to a second position 212, wherein it is not bridging the first 202 and second 204 support sections of the privacy wall 106, the privacy wall 106 may bend along the flexible connector 206, and the changing station 200 may be converted from the deployed position 120 of FIG. 2A, through the position shown in FIG. 2B, to the closed position 122, such as the position illustrated in FIG. 2C. As an option, changing station 200 may also comprise one or more fold lines 134 such that a compact position may be obtained. See FIG. 2C.

Figure 2D:
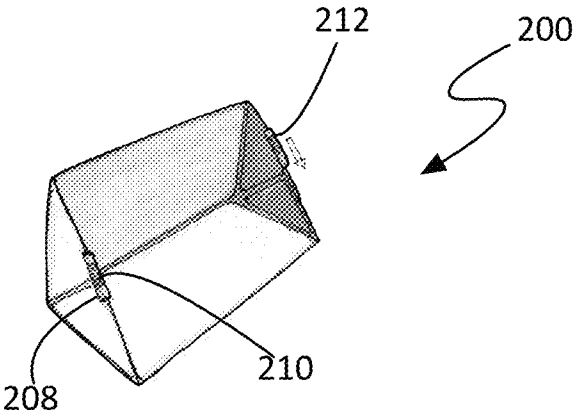
FIG. 2D is a perspective view of a particular implementation of a portable diaper changing station with privacy walls illustrating a sliding brace.
Figure 2E:
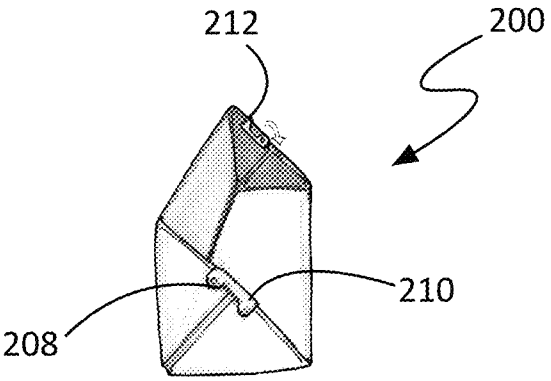
FIG. 2E is a perspective view of a particular implementation of a portable diaper changing station with privacy walls illustrating a swinging brace.

In some embodiments, the brace 208 may slide along the upper edge of a privacy wall 106, like the brace 208 shown in FIG. 2D. In other embodiments, the brace 208 may swing on a pivot, such as the brace 208 shown in FIG. 2E. In still other embodiments, the brace 208 may be located elsewhere along, or near, the flexible connector 206, according to various embodiments.

Figure 3B:
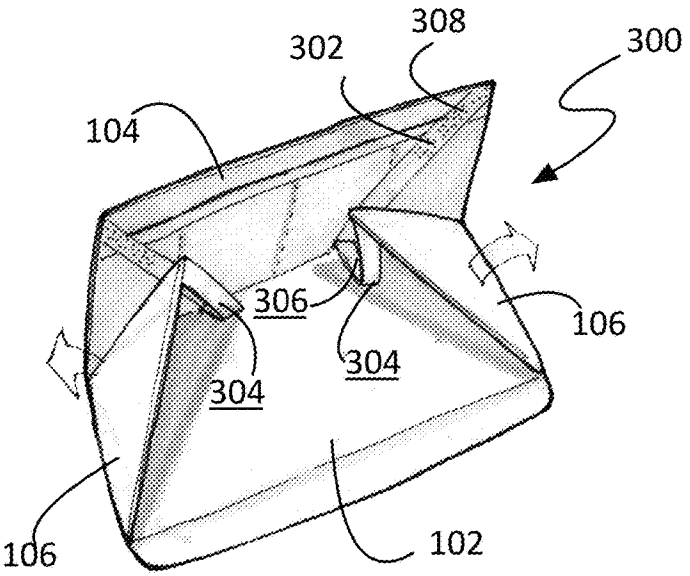
FIGS. 3A-3C are perspective views of a particular implementation of a portable diaper changing station with privacy walls and hook and loop fastener in deployed and closed positions.
Figure 3A:
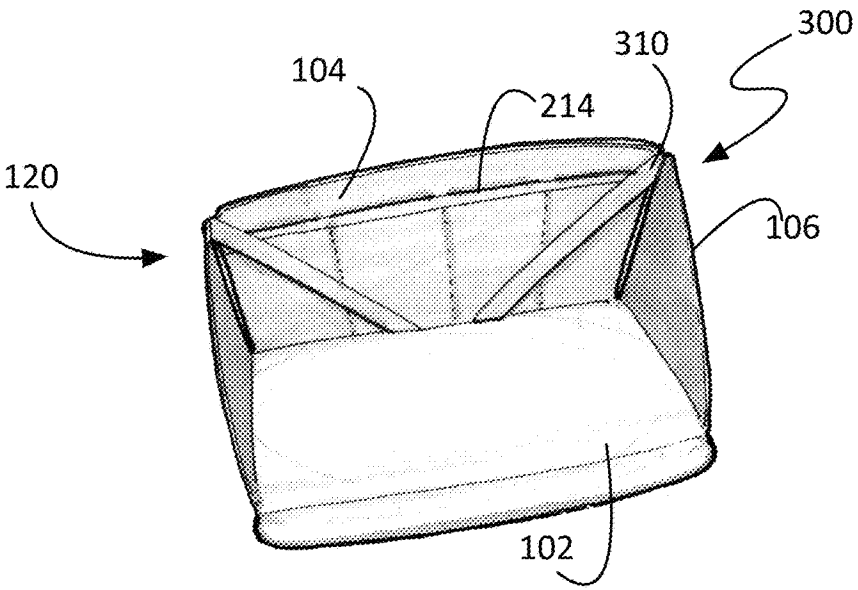
Figure 3C:
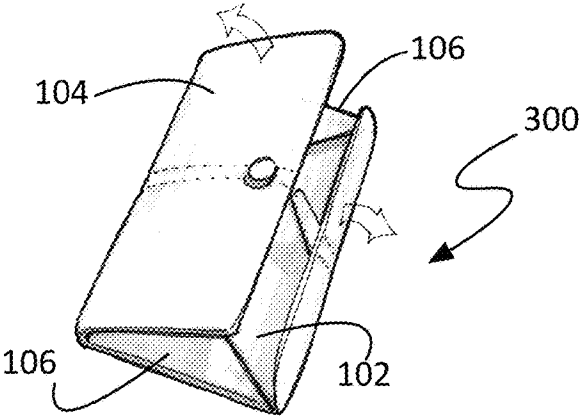

FIGS. 3A-3C are perspective views of a particular implementation of a personal bag with a portable diaper changing station 300 with privacy walls 106 and hook and loop fastener. FIG. 3A shows station 300 in a deployed position 120, which is maintained by a hook and loop fastener connection 310 between an anchor strap 302 affixed to the back wall 104 and a movable strap 304. As shown, the movable strap 304 has one end affixed to a privacy wall 106, and the other end is affixed near the end of an anchor strap 302, so that when the portable diaper changing station 300 is in a deployed position 120, the straps are in alignment.

FIGS. 3A and 3B depict the anchor strap 302 as having a hook portion 308 of the hook and loop fastener material, and the movable strap 304 has having a loop portion 306. In other embodiments, this may be reversed. In still other embodiments, the anchor strap 302 and the movable strap 304 may comprise any material that may become releasably coupled upon contact or proximity, such as magnets or magnetic strips.

FIG. 3A shows portable diaper changing station 300 in the deployed position 120. FIG. 3B shows station 300 as it is being converted to the closed position 122, the movable strap 304 having been decoupled from the anchor strap 302 and the privacy walls 106 being folded inward. FIG. 3C depicts changing station 300 in an almost closed state, and demonstrates a more fashionable outer surface for a station. Portable diaper changing station 300, as depicted, does not include fold lines 134 or the ability to move into a compact position 136; in other embodiments, a personal bag and portable diaper changing station may include the features of station 300 as well as the fold lines 134 or other structure needed to achieve a compact position 136.

Figure 4A:
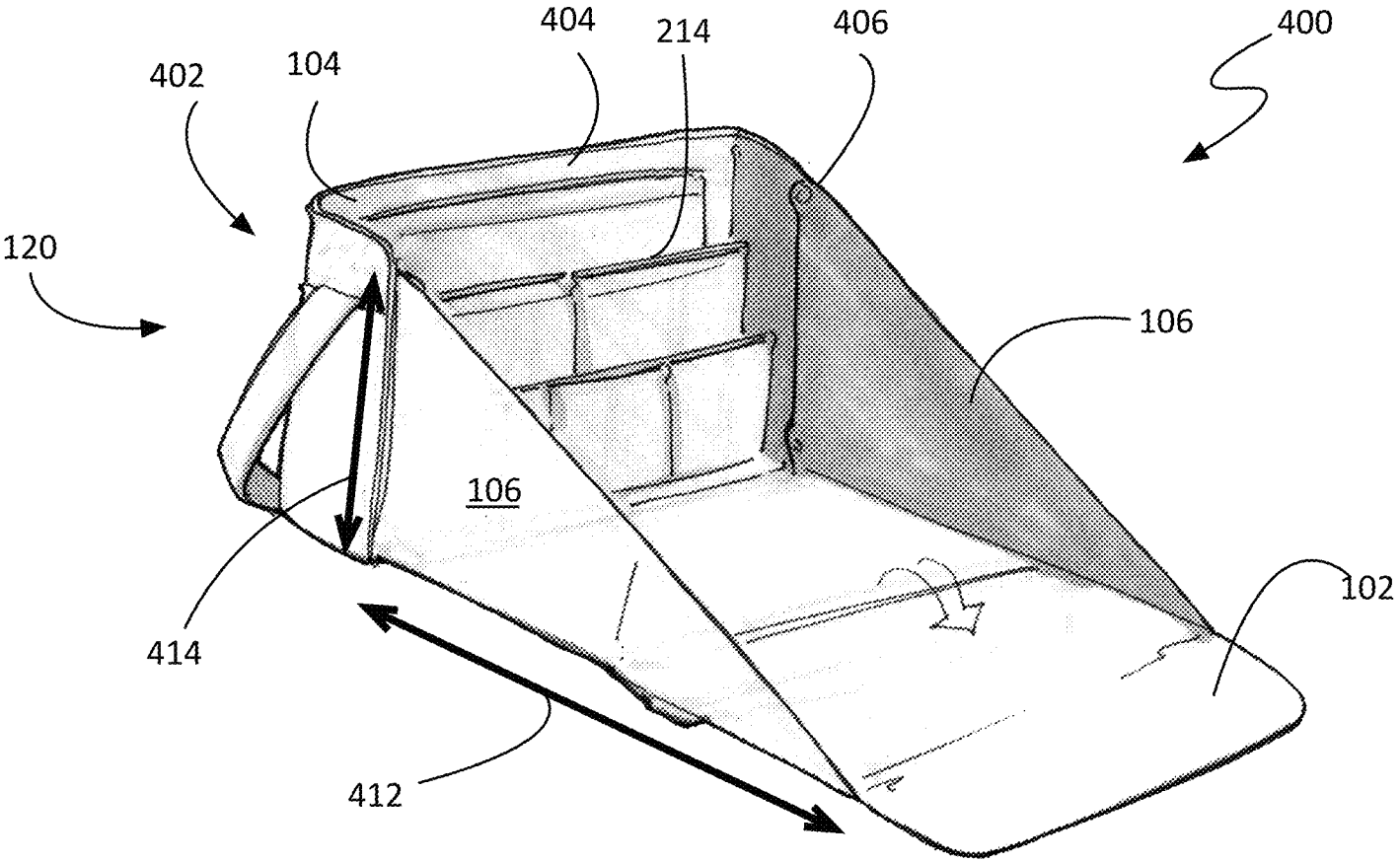
FIGS. 4A-4C are perspective views of a particular implementation of a portable diaper changing station with privacy walls and fasteners in deployed, open, and closed positions.
Figure 4C:
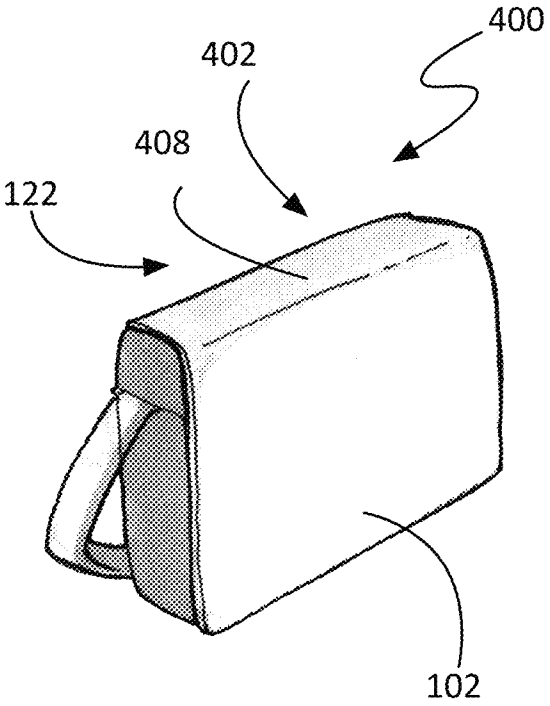
Figure 4B:
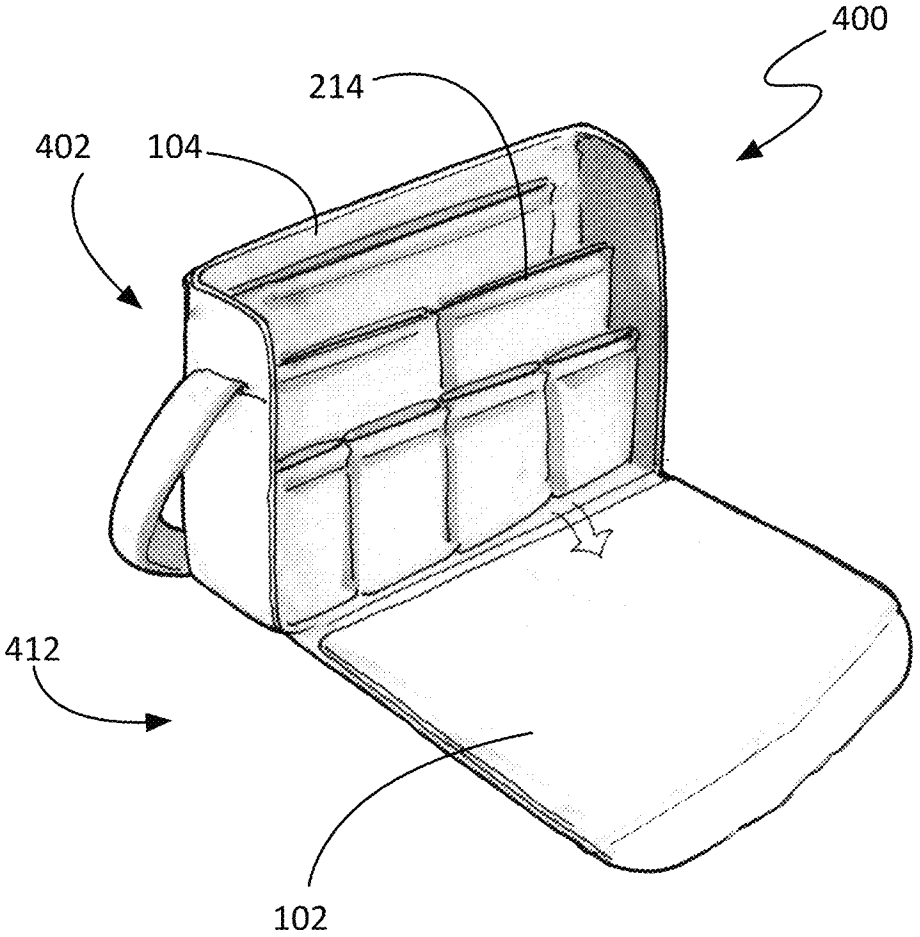

FIGS. 4A-4C are perspective views of a particular implementation of a personal bag with a portable diaper changing station 400 with privacy walls 106 and a fastener. Personal bag with a portable diaper changing station 400 also comprises a bag 402 having a sidewall 404, according to various embodiments. As shown in FIGS. 4A-4C, the bag 402 may be a messenger-style bag; in other embodiments, the bag 402 may be of any variety, including but not limited to totes, handbags, backpacks, satchels, and/or any other type of bag. The back wall 104 of station 400 is coupled to a sidewall 404 of the bag 402. In some embodiments, said coupling may be releasable, while in others, the back wall 104 may be affixed to the sidewall 404. In still other embodiments, the back wall 104 and the sidewall 404 may be the same wall.

As shown in FIG. 4A, the privacy walls 106 of station 400 are releasably coupled to the bag 402 (and thus the back wall 104) through a fastener 406. In the context of the present description and in the claims that follow, a fastener 406 may be any device with interlocking parts used for releasably coupling things together. As an option, the fastener 406 may be actuated with a linear motion, and may be operable with a single hand. As shown in FIG. 4A, the privacy walls 106 are coupled to the bag 402; in other embodiments that do not include a bag 402, the privacy walls 106 may be releasably coupled directly to the back wall 104 with the fasteners 406.

An additional position for a portable diaper changing station may be available in some embodiments where the upper end of the privacy walls 106 is releasably coupled to the back wall 104 (or, in some embodiments, through a bag 402) as seen in depictions of changing station 300 and changing station 400. FIG. 4B shows the portable diaper changing station 400 in an open position 412, where the base 102 is substantially perpendicular to the back wall 104, while the privacy walls 106 are substantially parallel to the base. Such a position may allow access to the storage (e.g. pocket 214, organizer 410, etc.) of the portable diaper changing station without having to be in the deployed position 120.

FIGS. 4A-4C demonstrate an embodiment of a personal bag with a portable diaper changing station where the base 102 is segmented. As shown, the base 102 of portable diaper changing station 400 is segmented, such that it may fold over on itself when in the open (e.g. FIG. 4B) or closed (e.g. FIG. 4C) position, and fold out when in the deployed position 120 (FIG. 4A). This increases the usable surface area of the base 102 when in the deployed position 120 without substantially increasing the space taken up by the base 102 in the open or closed positions.

FIG. 4C shows the portable diaper changing station 400 in the closed position 122. As shown, in this position the base 102 also serves as a lid 408 for the bag 402. Embodiments with such an arrangement make the additional storage capacity of the bag 402 readily available when the station is placed in the deployed position 120, without requiring the user to open additional compartments.

Figure 5:
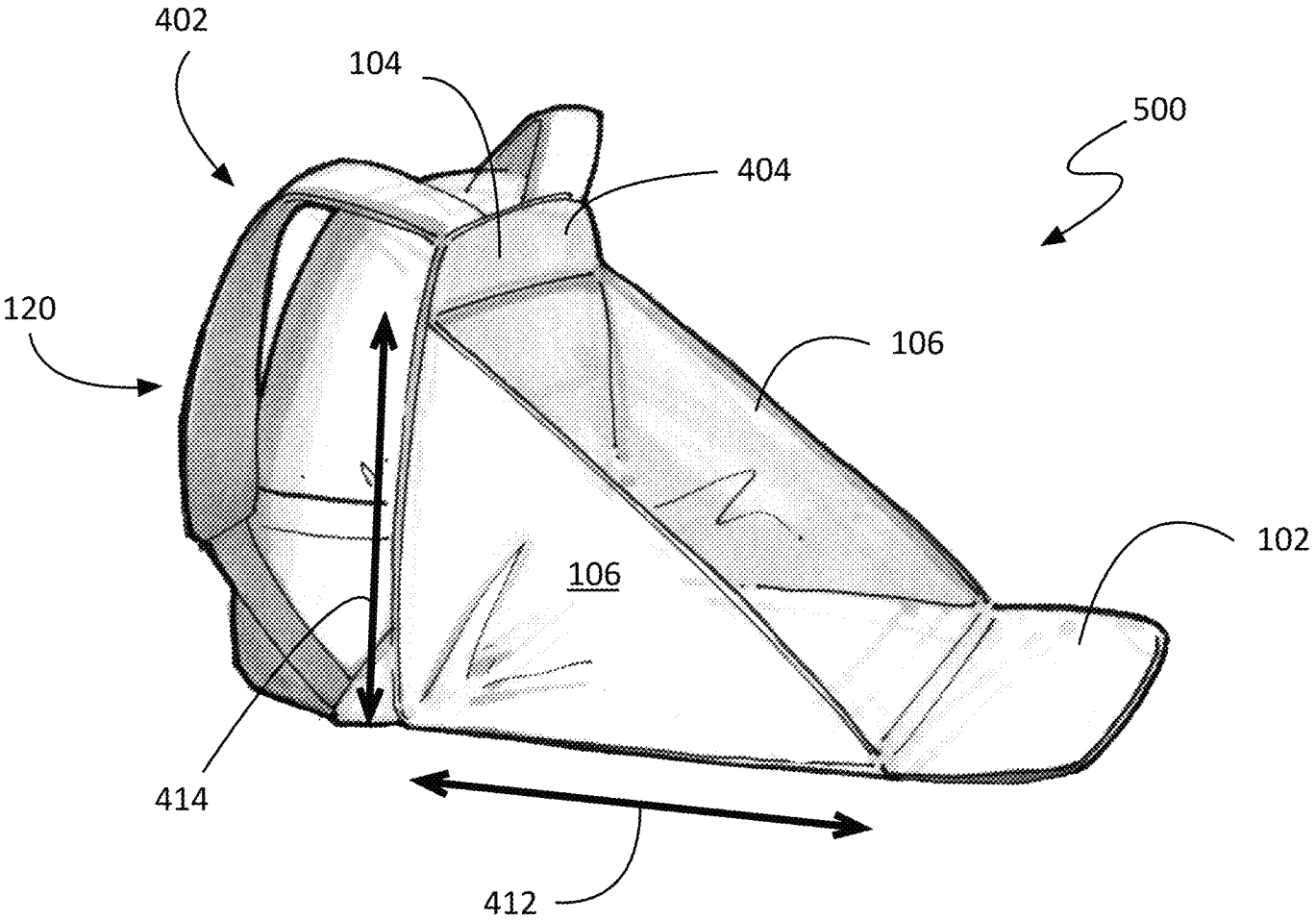
FIG. 5 is a perspective view of a particular implementation of a portable diaper changing station comprising a backpack with privacy walls in a deployed position.

FIG. 5 is a perspective view of a particular implementation of a personal bag with a portable diaper changing station 500 comprising a backpack 402 with privacy walls 106. As shown, the back wall 104 of personal bag with a portable diaper changing station 500 is coupled to the sidewall 404 of a backpack which serves as the back of the backpack (e.g. the surface resting along the users back when the backpack is worn). Changing station 500 demonstrates the benefits of making use of a large, somewhat planar surface that is inherent to the incorporated bag 402, in that the base 102 may be large and non-segmented (e.g. continuous padding, etc.) without being cumbersome.

Figure 6:
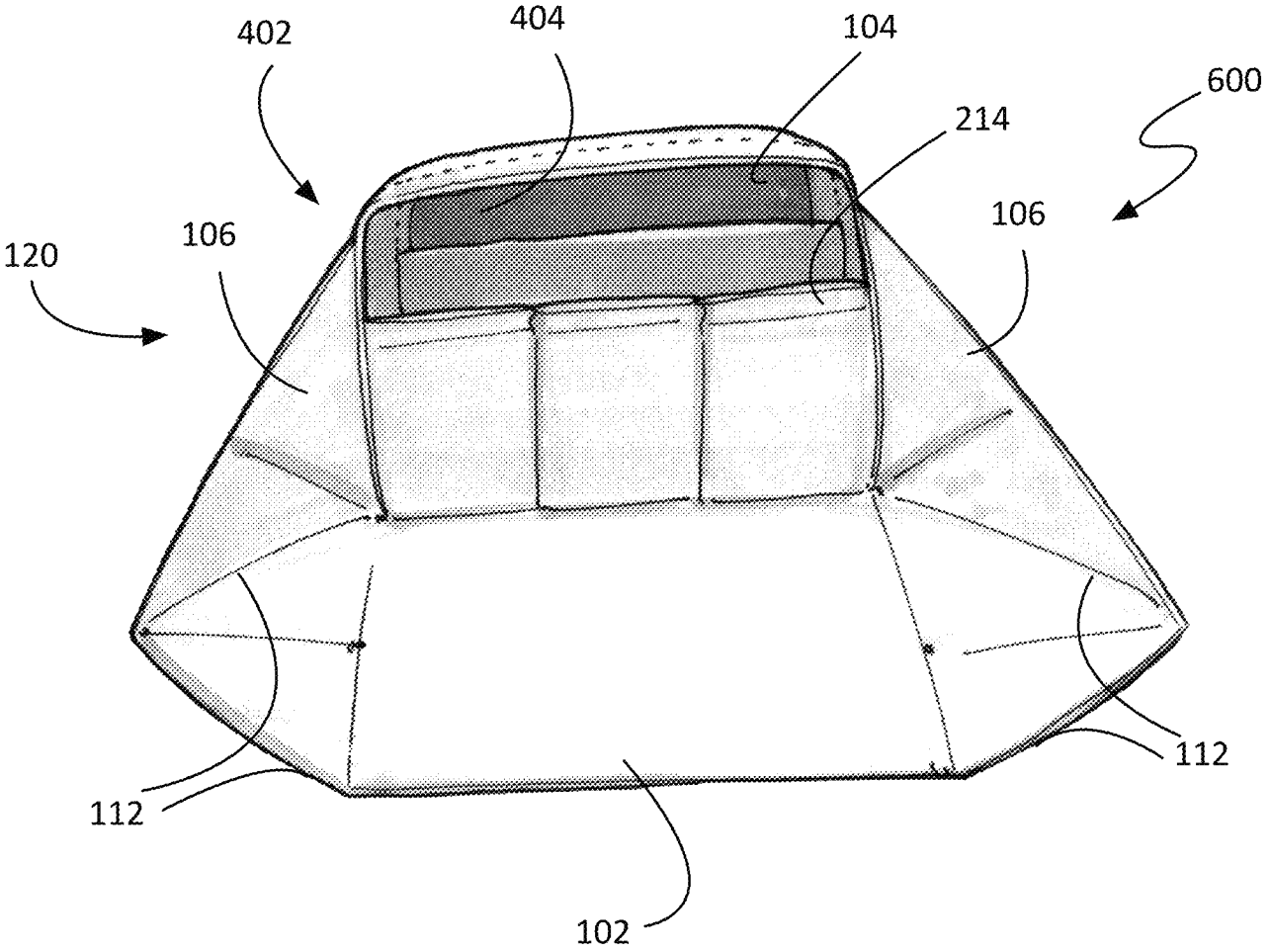
FIG. 6 is a perspective view of a particular implementation of a portable diaper changing station comprising a bag with privacy walls in a deployed position.

FIG. 6 is a perspective view of a particular implementation of a personal bag with a portable diaper changing station 600, comprising a bag 402 with privacy walls 106. FIG. 6 demonstrates an embodiment of a personal bag having suspended pockets 214 on a surface 216 of the back wall 104. In the context of the present description, suspended pockets 214 may refer to layered pockets, pouches, or other containers that are vertically staggered, such that all their openings may be visible and easily accessible to the user when the station is in the deployed position 120. The use of suspended pockets 214 takes advantage of the additional depth provided by the bag 402. In some embodiments, any space beneath/behind the suspended pockets 214 may be utilized by the user through another opening (see, for example, FIGS. 7-9). Such a compartment may be separated from the rest of the station by a sidewall, as an option.

Figure 7B:
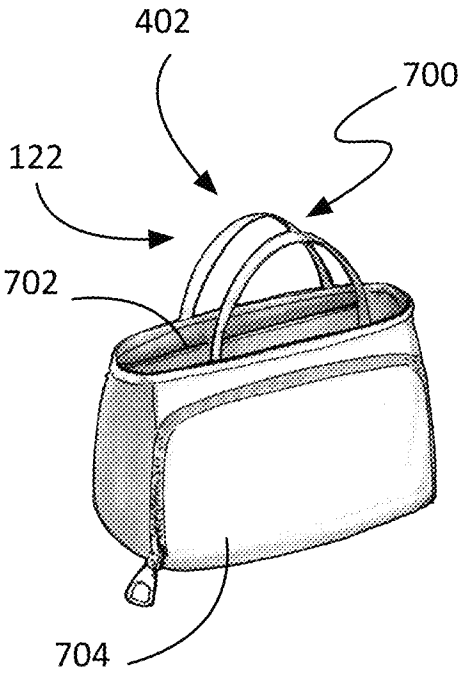
FIGS. 7A and 7B are perspective views of a particular implementation of a portable diaper changing station comprising a tote bag with privacy walls in deployed and closed positions.
Figure 7A:
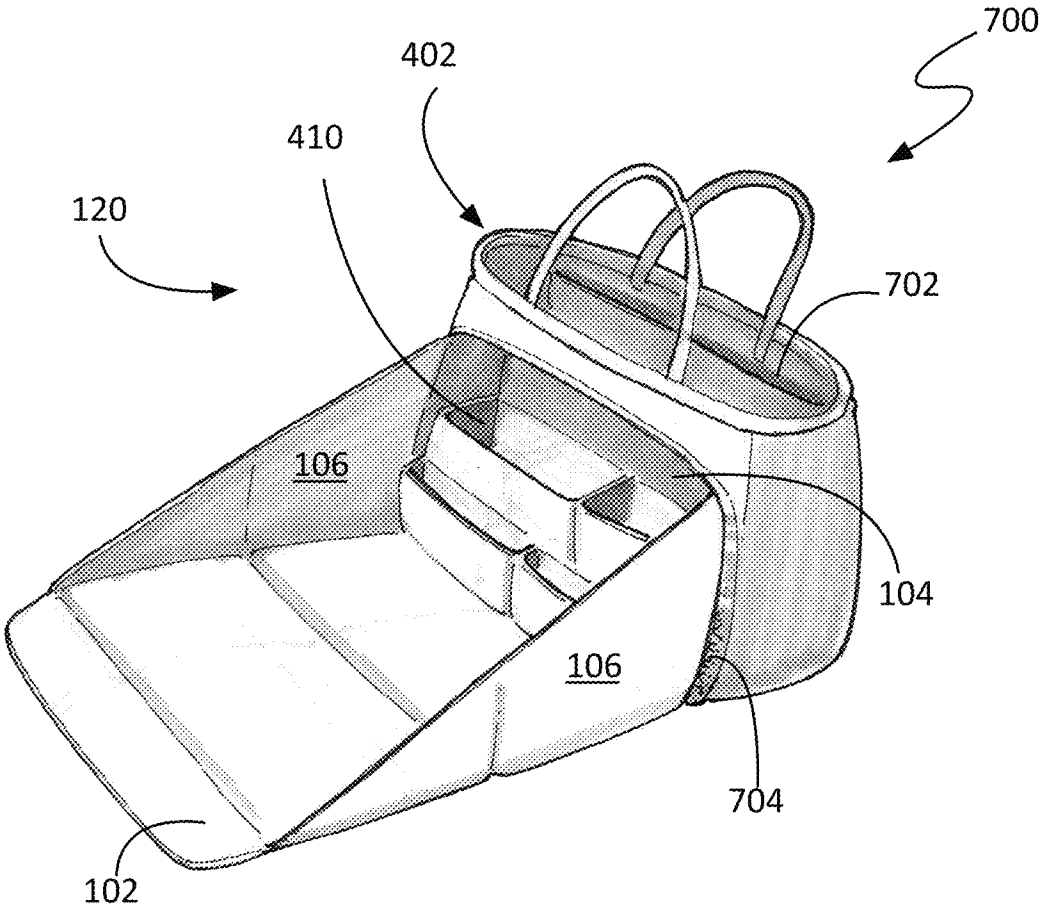

FIGS. 7A and 7B are perspective views of a particular implementation of a personal bag with a portable diaper changing station 700 comprising a tote bag 402 with privacy walls 106. The tote bag 402 further comprises an additional opening 702 through which the organizer 410 may be accessed. In some embodiments, the opening 702 may be limited to accessing a compartment outside of and partitioned from the back wall 104 and the base 102, allowing the tote bag 402 to also be used as a traditional tote bag. As an option, the organizer 410 may be releasably coupled to the bag 402, such that it may be removed on that happy day when diaper changing is no longer needed, and the station 700 may be employed as a traditional tote.

Personal bag with a portable diaper changing station 700 also includes an outer pocket 704, according to various embodiments. When the changing station 700 is in a closed position 122, as shown in FIG. 7B, the base 102, the back wall 104, and the privacy walls 106 may be enclosed within the outer pocket 704.

Figure 8B:
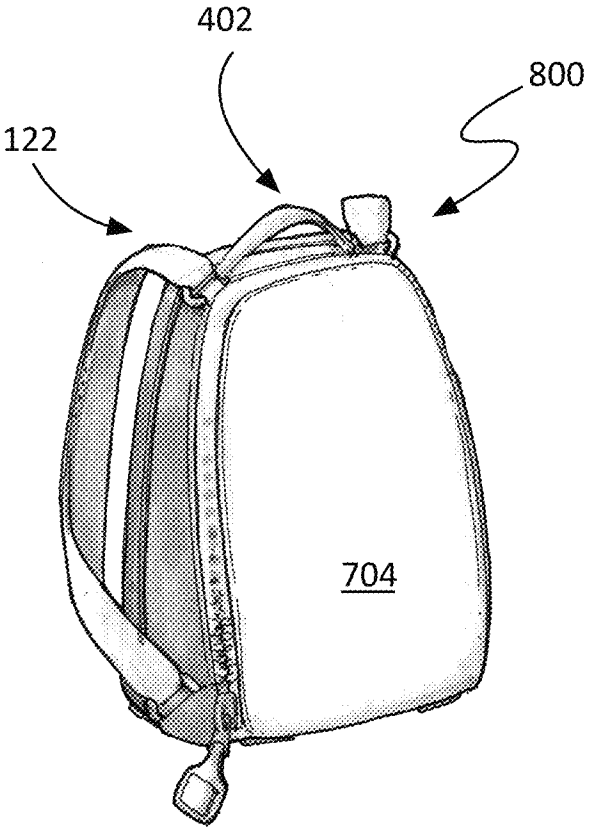
FIGS. 8A and 8B are perspective views of a particular implementation of a portable diaper changing station comprising a backpack with privacy walls in deployed and closed positions.
Figure 8A:
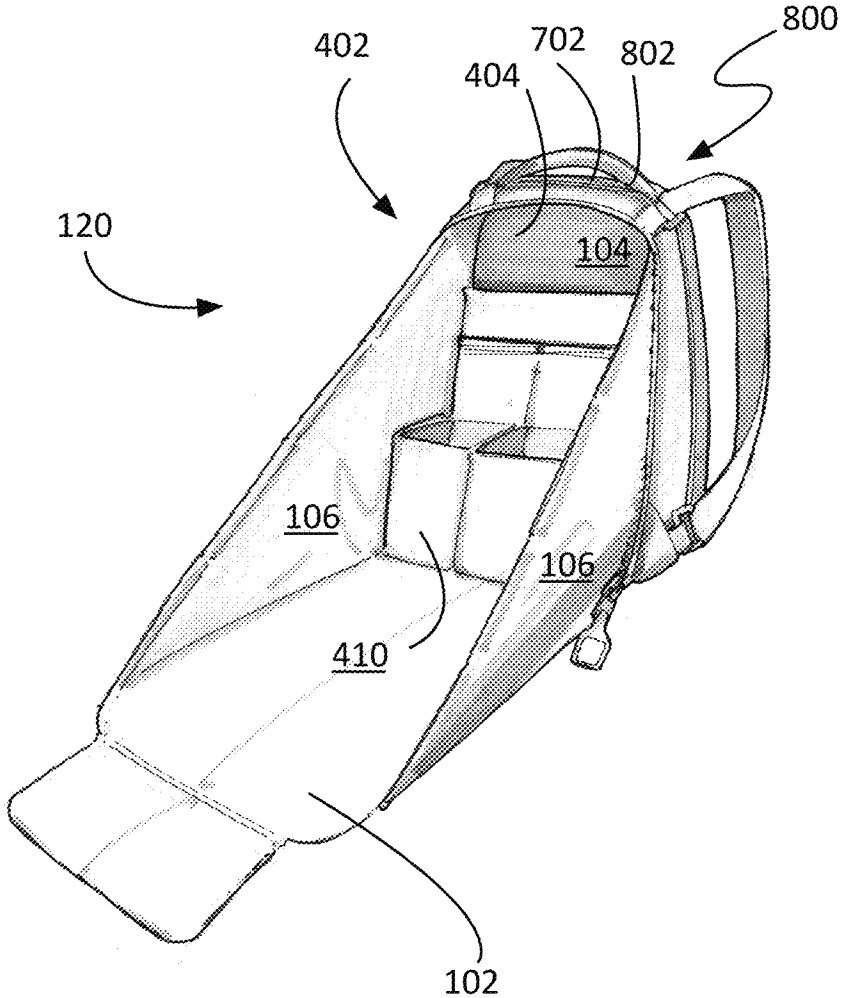

FIGS. 8A and 8B are perspective views of a particular implementation of a personal bag with a portable diaper changing station 800 comprising a backpack 402 with privacy walls 106. Unlike the personal bag with the portable diaper changing station 400 illustrated in relation to previous embodiments, which also incorporated a backpack, the changing station 800 illustrated in FIGS. 8A and 8B is deployed from the front of the backpack, as shown in FIG. 8A. FIG. 8B illustrates a portable diaper changing station 800 in the closed position 122, with the base 102, back wall 104, and the privacy walls 106 enclosed within an outer pocket 704 of the backpack. The personal bag with the portable diaper changing station 800 may also include a separate compartment 802, which may be thought of as a "parent pocket", separated from the diaper changing supplies and structures and accessible through an opening 702. The parent pocket may further be lined with a water-resistant or waterproof liner to protect electronics, wallets or other water-sensitive items.

Figure 9A:
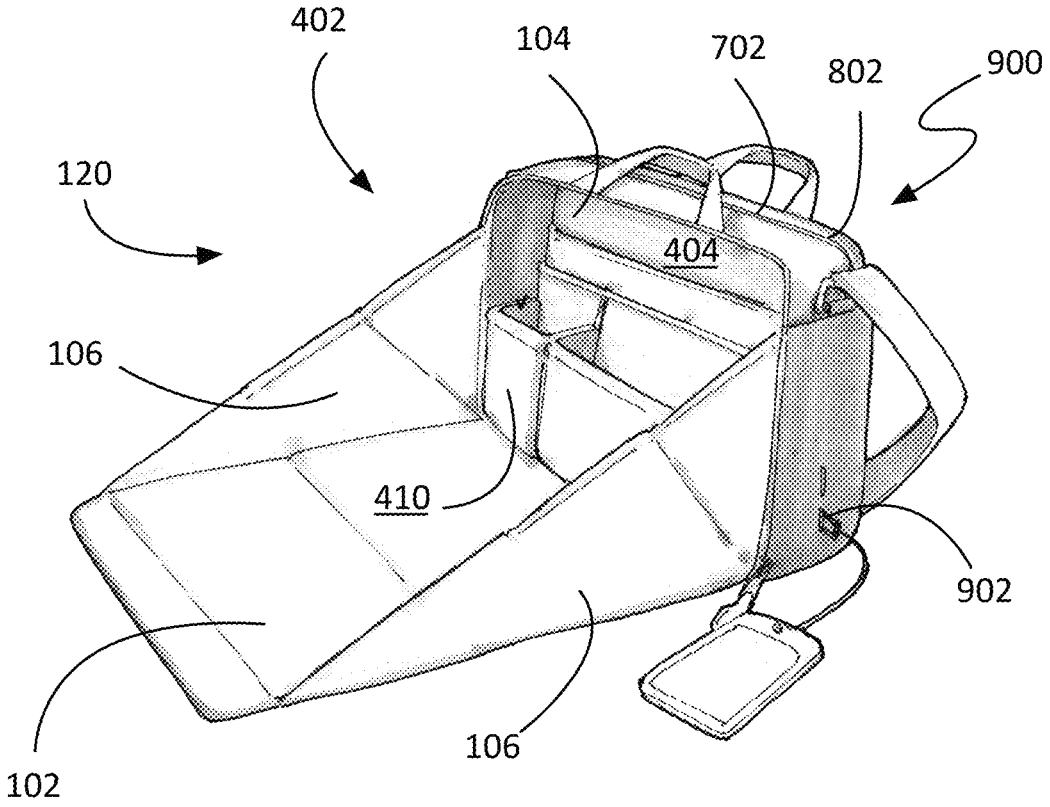
FIGS. 9A and 9B are perspective views of a particular implementation of a portable diaper changing station comprising a messenger bag with privacy walls in deployed and closed positions.
Figure 9B:
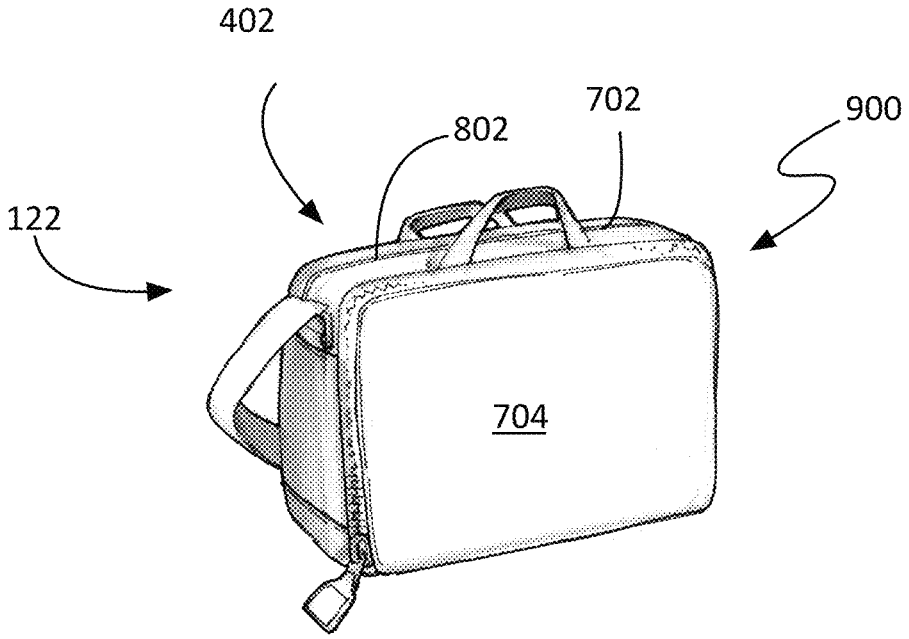

FIGS. 9A and 9B are perspective views of a particular implementation of a personal bag with a portable diaper changing station 900 comprising a messenger bag 402 with privacy walls 106 and a rechargeable power source 902. FIG. 9A, which shows a changing station 900 in the deployed position 120, also shows the rechargeable power source 902 in use. In some embodiments, the power source 902 may be used to charge mobile devices such as a phone or a tablet. In other embodiments, the power source 902 may be used to power a bottle warmer, which may be incorporated with the diaper changing station.

One of the reasons for using a personal bag with a portable diaper changing station, such as the embodiments disclosed herein, is to protect the baby from unclean surfaces. The embodiments disclosed may be implemented in a variety of materials, including fabrics, plastics, and other materials that are waterproof and easy to clean. Some embodiments of the portable diaper changing station may include parts, such as the base 102, the back wall 104, the privacy walls 106, and or covers for some or all of these parts, which may be machine washable. Other embodiments may incorporate anti-microbial surfaces and materials. Still other embodiments may employ disposable covers.

In places where the description above refers to particular implementations of a portable diaper changing station, it should be readily apparent that a number of modifications may be made without departing from the spirit thereof and that these implementations may be applied to other portable diaper changing stations. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. A personal bag having an integrated diaper changing station, comprising:

a personal bag having a closeable outer shell formed with a front side and a back side, and sidewalls, the personal bag having an inner compartment, forming a largest space within the personal bag, the inner compartment accessible from a first opening and accessible from a second opening on the front side;

a diaper changing base removably coupled inside the inner compartment at the front side of the personal bag, the diaper changing base comprising a front edge, a rear edge and lateral edges and a padded surface, a back wall releasably attached to the sidewalls of the personal bag and having a bottom edge and lateral edges; and at least two privacy walls, each privacy wall coupled to and extending along a majority of a different lateral edge of the diaper changing base, and also coupled to and extending along a majority of a different lateral edge of the back wall;

wherein the rear edge of the diaper changing base is hingedly coupled to the bottom edge of the back wall and hingedly movable relative to the back wall between a closed position in which the diaper changing base is substantially parallel to the back wall and the at least two privacy walls are between the back wall and the diaper changing base, and a deployed position in which the diaper changing base is substantially perpendicular to the back wall, an angle between the back wall and the diaper changing base in the deployed position being defined by a size of the at least two privacy walls when in the deployed position;

wherein the diaper changing base is configured to deploy from inside the inner compartment of the personal bag through the second opening on the front side by opening an outer pocket on the front side and exposing the inner compartment, and moving the base to the open position with the inner compartment exposed;

wherein in a closed position, the diaper changing base is enclosed within the inner chamber of the personal bag, and wherein the personal bag having at least one shoulder strap configured to extend across the second opening on the front side when the personal bag is worn by a user.

2. The personal bag of claim 1, further comprising:

at least a first rigid frame segment coupled to the diaper changing base and at least a second rigid frame segment coupled to the back wall, the first and second rigid frame segments coupled together through a biased hinge biasing the diaper changing base to the deployed position.

3. The personal bag of claim 1, wherein each privacy wall comprises:

first and second support sections flexibly coupled to each other by a flexible connector; and at least one brace coupled to the first support section and movable to a first position in which the brace bridges the first and second support sections, and a second position in which it does not, the at least one brace maintaining the changing station in the deployed position when the at least one brace is in the first position.

4. The personal bag of claim 1, further comprising:

an anchor strap affixed to the back wall; and a movable strap having one end affixed to one of the at least two privacy walls;

wherein one of the anchor strap and the movable strap comprise a hook portion of a hook and loop fastener material and the other of the anchor strap and the movable strap comprise a loop portion of the hook and loop fastener material, the anchor strap being aligned with the movable strap when the station is in the deployed position to form a hook and loop fastener connection.

5. The personal bag of claim 1, wherein each of the two privacy walls is releasably coupled to the back wall through a corresponding fastener.

6. The personal bag of claim 1, wherein in the deployed position there is no barrier on the front edge of the diaper changing base.

7. The personal bag of claim 1, wherein the diaper changing base further comprises at least one fold line, the back further comprises at least one fold line aligned with the at least one fold line of the diaper changing base while in the closed position, and wherein folding the changing station in the closed position along the at least one fold lines on the back wall and diaper changing base converts the station from the closed position to a compact position.

8. The personal bag of claim 1, wherein the back wall further comprises at least one pocket on a surface of the back wall between the privacy walls.

9. The personal bag of claim 1, wherein the back wall comprises a sidewall of a bag.

10. A personal bag having an integrated diaper changing station, comprising:

a diaper changing base having a front edge, a rear edge, lateral edges, and a padded surface;

a bag comprising a front side, a back side, a plurality of sidewalls, and a bottom surface defining an inner compartment forming a largest space within the bag, the inner compartment accessible through at least one opening; and at least two privacy walls, each privacy wall coupled to and extending along a different lateral edge of the diaper changing base, coupled to the bag, and extending along a different sidewall of the bag;

wherein the rear edge of the diaper changing base is hingedly coupled to the bottom surface of the bag and hingedly movable relative to the bag between a closed position in which the diaper changing base is substantially perpendicular to the bottom surface of the bag and the at least two privacy walls are within the inner compartment of the bag, and a deployed position in which the diaper changing base is substantially parallel to the bottom surface of the bag; and wherein the diaper changing base is configured to deploy from inside the inner compartment of the bag through the at least one opening.

11. The personal bag of claim 10, further comprising:

at least a first rigid frame segment coupled to the diaper changing base and at least a second rigid frame segment coupled to the bag, the first and second rigid frame segments coupled together through a biased hinge biasing the diaper changing base to the deployed position.

12. The personal bag of claim 10, wherein each privacy wall comprises:

first and second support sections flexibly coupled to each other by a flexible connector; and at least one brace coupled to the first support section and movable to a first position in which the brace bridges the first and second support sections, and a second position in which it does not, the at least one brace maintaining the changing station in the deployed position when the at least one brace is in the first position.

13. The personal bag of claim 10:

an anchor strap affixed to the bag; and a movable strap having one end affixed to one of the at least two privacy walls;

wherein one of the anchor strap and the movable strap comprise a hook portion of a hook and loop fastener material and the other of the anchor strap and the movable strap comprise a loop portion of the hook and loop fastener material, the anchor strap being aligned with the movable strap when the station is in the deployed position to form a hook and loop fastener connection.

14. The personal bag of claim 10, wherein in the deployed position there is no barrier on the front edge of the diaper changing base.

15. The personal bag of claim 10 wherein each of the two privacy walls is releasably coupled to the bag through a corresponding fastener.

16. The personal bag of claim 10, further comprising an organizer comprising at least one pocket and coupled to the bag within the inner compartment.

17. The personal bag of claim 10, wherein the diaper changing base serves as a lid for at least one of the at least one opening of the bag while the bag is in the closed position.

18. The personal bag of claim 10, wherein the bag further comprises a compartment located outside the diaper changing base and the back wall and accessible through one of the at least one openings of the bag when the station is in the open position and in the closed position.

19. A personal bag having an integrated diaper changing station, comprising:

a diaper changing base having a front edge, a rear edge and lateral edges and a padded surface;

a bag comprising at least one opening and a back wall, the back wall having a bottom edge and lateral edges;

at least two privacy walls, each privacy wall coupled to and extending along a different lateral edge of the diaper changing base, coupled to the bag, and also extending along a lateral edge of the back wall;

wherein the rear edge of the diaper changing base is hingedly coupled to the bottom edge of the back wall and hingedly movable relative to the back wall between a closed position in which the diaper changing base is substantially parallel to the back wall and the at least two privacy walls are between the back wall and the diaper changing base, and a deployed position in which the diaper changing base is substantially perpendicular to the back wall, an angle between the back wall and the diaper changing base in the deployed position being defined by a size of the at least two privacy walls when in the deployed position; and wherein the diaper changing base is configured to deploy from inside an inner compartment of the bag through the at least one opening, wherein the inner compartment forms a space within the bag larger than any other space within the bag.

20. The personal bag of claim 19, further comprising a rechargeable power source.

* * * * *